US008740651B2

(12) United States Patent
Lee

(10) Patent No.: US 8,740,651 B2
(45) Date of Patent: Jun. 3, 2014

(54) LEAD ARRANGEMENT, ELECTRIC CONNECTOR AND ELECTRIC ASSEMBLY

(75) Inventor: Sheng-Yuan Lee, New Taipei (TW)

(73) Assignee: VIA Technologies, Inc., New Taipei (TW)

( * ) Notice: Subject to any disclaimer, the term of this patent is extended or adjusted under 35 U.S.C. 154(b) by 28 days.

(21) Appl. No.: 13/615,578

(22) Filed: Sep. 13, 2012

(65) Prior Publication Data

US 2013/0012067 A1 Jan. 10, 2013

Related U.S. Application Data

(63) Continuation-in-part of application No. 12/615,455, filed on Nov. 10, 2009, now Pat. No. 8,303,315.

(30) Foreign Application Priority Data

Sep. 18, 2009 (TW) ..... 98131588 A
Jul. 18, 2012 (TW) ..... 101213859 A

(51) Int. Cl.
*H01R 13/66* (2006.01)

(52) U.S. Cl.
USPC ..... 439/620.24; 439/79; 439/108

(58) Field of Classification Search
None
See application file for complete search history.

(56) References Cited

U.S. PATENT DOCUMENTS 6,863,549 B2 3/2005 Brunker et al.
6,935,870 B2 8/2005 Kato et al.
6,953,351 B2 10/2005 Fromm et al.
6,994,569 B2 2/2006 Minich et al.
7,331,800 B2 2/2008 Winings et al.
2006/0228912 A1 10/2006 Morlion et al.
2010/0173529 A1 7/2010 He et al.
2011/0001223 A1* 1/2011 Lee ..... 257/666

FOREIGN PATENT DOCUMENTS

CN 101409395 4/2009
TW M329880 4/2008
TW M362526 8/2009

OTHER PUBLICATIONS

"Office Action of U.S. counterpart application" issued on Apr. 9, 2012, p. 1-p. 8.
"First Office Action of China Counterpart Application", issued on Dec. 9, 2010, p. 1-p. 4.

* cited by examiner

*Primary Examiner* — Michael Zarroli
(74) *Attorney, Agent, or Firm* — Jianq Chyun IP Office

(57) ABSTRACT

A lead arrangement is provided for an electric connector. The lead arrangement includes a first lead lane that includes a pair of first differential signal leads, a pair of second differential signal leads and a first ground lead between the two pairs of differential signal leads. Each of the first differential signal leads, the second differential signal leads and the ground lead has a surface mounting segment adapted for being soldered onto a surface pad of a circuit board. The pair of first differential signal leads is a pair of transmitting differential signal leads $T_x^+$ and $T_x^-$ in architecture of universal serial bus 3.0 (USB 3.0), and the pair of second differential signal leads is a pair of receiving differential signal leads $R_x^+$ and $R_x^-$ in architecture of USB 3.0.

21 Claims, 9 Drawing Sheets

LEAD ARRANGEMENT, ELECTRIC CONNECTOR AND ELECTRIC ASSEMBLY

CROSS-REFERENCE TO RELATED APPLICATION

This application is a continuation-in-part of and claims the priority benefit of U.S. application Ser. No. 12/615,455, filed on Nov. 10, 2009, now allowed as U.S. Pat. No. 8,303,315, and also claims the priority benefit of Taiwan application serial no. 101213859, filed on Jul. 18, 2012. The prior U.S. application Ser. No. 12/615,455 claims the priority benefit of Taiwan application serial no. 98131588, filed on Sep. 18, 2009. The entirety of each of the above-mentioned patent applications is hereby incorporated by reference herein and made a part of this specification.

BACKGROUND OF THE INVENTION

1. Field of Invention

The present invention relates to an electric connector, and particularly to a lead arrangement for an electric connector, and an electric connector and an electric assembly having the same.

2. Description of Related Art

Universal serial bus 3.0 (USB 3.0) is a signal transmission specification developed from USB 2.0, and a transmission rate thereof may reach 5 G bps, while a transmission rate of a conventional USB 2.0 is only 480M bps. Currently, it has been confirmed that USB 3.0 electric connectors are compatible with USB 2.0 electric connectors, i.e. USB 3.0 adopts the same electric connector structure as USB 2.0 and has several additional leads dedicated to providing the USB 3.0 function. Therefore, it is desired to develop the USB 3.0 electric connector structure based on the USB 2.0 electric connector structure so as to meet market demands.

SUMMARY OF THE INVENTION

The present invention proposes a lead arrangement suitable for an electric connector. The lead arrangement includes a first lead lane, which includes a pair of first differential signal leads, a pair of second differential signal leads, and a first ground lead positioned between the two pairs of differential signal leads. Each of the pair of first differential signal leads, the pair of second differential signal leads and the first ground lead has a surface mounting segment adapted for being soldered onto a surface pad of a circuit board. The pair of first differential signal leads is a pair of transmitting differential signal leads $T_x^+$ and $T_x^-$ in architecture of universal serial bus 3.0 (USB 3.0), and the pair of second differential signal leads is a pair of receiving differential signal leads $R_x^+$ and $R_x^-$ in architecture of USB 3.0.

The present invention proposes an electric connector, which includes a metal housing, an insulating base connected to the metal housing, and a lead arrangement disposed on the insulating base. The lead arrangement includes a first lead lane, which includes a pair of first differential signal leads, a pair of second differential signal leads, and a first ground lead positioned between the two pairs of differential signal leads. Each of the pair of first differential signal leads, the pair of second differential signal leads and the first ground lead has a surface mounting segment adapted for being soldered onto a surface pad of a circuit board. The pair of first differential signal leads is a pair of transmitting differential signal leads $T_x^+$ and $T_x^-$ in architecture of USB 3.0, and the pair of second differential signal leads is a pair of receiving differential signal leads $R_x^+$ and $R_x^-$ in architecture of USB 3.0.

The present invention proposes an electric assembly, which includes a circuit board and an electric connector. The circuit board has a plurality of surface pads and a plurality of through vias. The electric connector includes a metal housing, an insulating base connected to the metal housing, and a lead arrangement disposed on the insulating base. The lead arrangement includes a first lead lane, which includes a pair of first differential signal leads, a pair of second differential signal leads, and a first ground lead positioned between the two pairs of differential signal leads. Each of the pair of first differential signal leads, the pair of second differential signal leads and the first ground lead has a surface mounting segment soldered respectively onto the surface pads. The pair of first differential signal leads is a pair of transmitting differential signal leads $T_x^+$ and $T_x^-$ in architecture of USB 3.0, and the pair of second differential signal leads is a pair of receiving differential signal leads $R_x^+$ and $R_x^-$ in architecture of USB 3.0.

The present invention proposes an electric assembly, which includes a circuit board, an electric connector and a signal processing unit. The electric connector includes a metal housing, an insulating base connected to the metal housing, and a lead arrangement disposed on the insulating base. The lead arrangement includes a first lead lane, which includes a pair of first differential signal leads, a pair of second differential signal leads, and a first ground lead positioned between the two pairs of differential signal leads. Each of the pair of first differential signal leads, the pair of second differential signal leads and the first ground lead has a surface mounting segment soldered respectively onto the surface pads. The signal processing unit disposed on the circuit board simultaneously transmits signals to the pair of first differential signal leads and receives signals from the pair of second differential signal leads through the surface pads.

In view of the foregoing, in the present invention, some pairs of critical differential signal leads and the ground lead of the electric connector are soldered onto the surface pads of the circuit board by surface mounting, thus avoiding an impact on transmission of critical signals as well as maintaining quality of high speed signal channel.

In order to make the aforementioned and other features and advantages of the present invention more comprehensible, several embodiments accompanied with figures are described in detail below.

DESCRIPTION OF EMBODIMENTS

Figure 1:
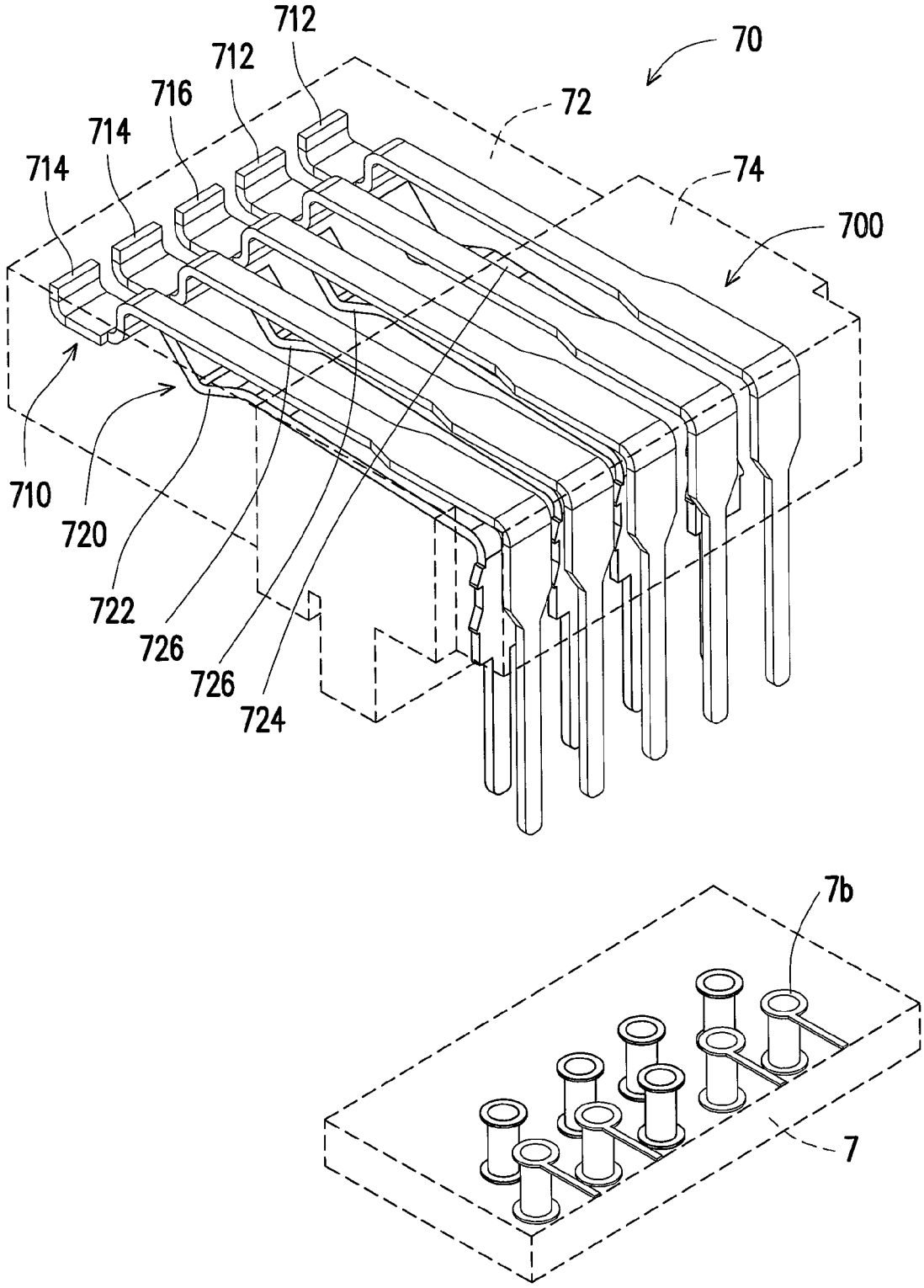
FIG. 1 and FIG. 2 illustrate a USB 3.0 electric connector according to an embodiment of the present invention, before and after assembly to a circuit board, respectively.
Figure 2:
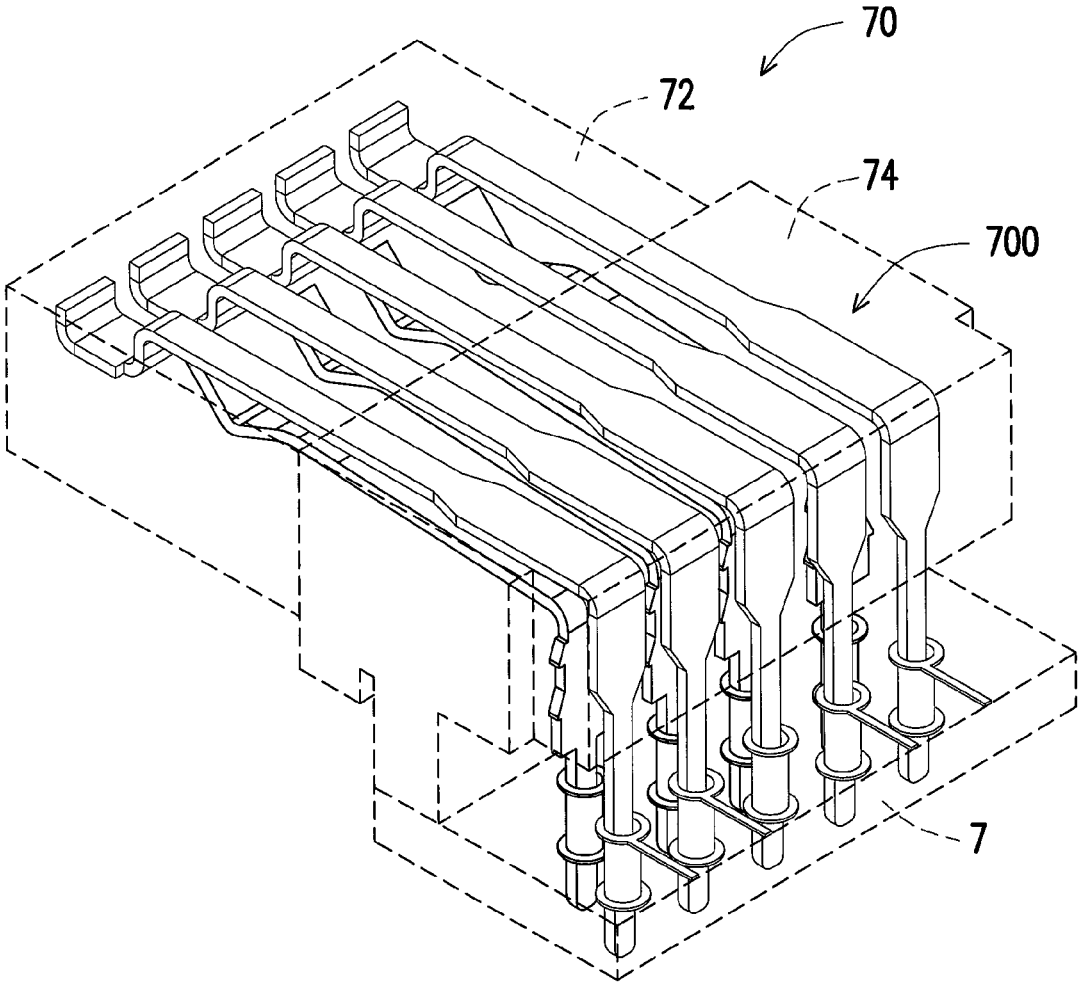

FIG. 1 and FIG. 2 illustrate a USB 3.0 electric connector according to an embodiment of the present invention, before and after assembly to a circuit board, respectively. Referring to FIG. 1 and FIG. 2, an electric connector 70 of the present embodiment is adapted for being soldered onto a circuit board 7, the electric connector 70 and the circuit board 7 collectively forming an electric assembly.

The electric connector 70 includes a metal housing 72, an insulating base 74 connected to the metal housing 72, and a lead arrangement 700 disposed on the insulating base 74. The lead arrangement 700 includes a first lead lane 710, and a second lead lane 720 positioned side-by-side with the first lead lane 710.

The first lead lane 710 includes a pair of first differential signal leads 712, a pair of second differential signal leads 714, and a first ground lead 716 positioned between the two pairs of differential signal leads 712 and 714. In the present embodiment, the pair of first differential signal leads 712 is a pair of transmitting differential signal leads $T_x^+$ and $T_x^-$ in architecture of USB 3.0, and the pair of second differential signal leads 714 is a pair of receiving differential signal leads $R_x^+$ and $R_x^-$ in architecture of USB 3.0.

The second lead lane 720 includes a second ground lead 722, a power lead 724, and a pair of third differential signal leads 726 positioned between the second ground lead 722 and the power lead 724. In the present embodiment, the pair of third differential signal leads 726 is a pair of transmitting/receiving differential signal leads $D^+$ and $D^-$ in architecture of USB 3.0 but supporting architecture of USB 1.0 or architecture of USB 2.0.

In architecture of USB 3.0, the transmitting differential signal leads ($T_x^+$ and $T_x^-$) and the receiving differential signal leads ($R_x^+$ and $R_x^-$) operate in a full-duplex transmission mode, i.e. an electronic device performs transmitting and receiving of the signals at the same time via the transmitting differential signal leads ($T_x^+$ and $T_x^-$) and the receiving differential signal leads ($R_x^+$ and $R_x^-$). In addition, the transmitting/receiving differential signal leads ($D^+$ and $D^-$) operate in a half-duplex transmission mode, i.e. an electronic device performs transmitting or receiving of data via the differential signal leads ($D^+$ and $D^-$). That means data receiving is not allowed when data transmitting is being performed, while data transmitting is not allowed when data receiving is being performed.

To ensure the electric connector 70 to be stably mounted onto the circuit board 7, all the aforementioned leads are soldered into through vias 7*b* of the circuit board 7 by passing the through vias 7*b*. In addition, to avoid any undesired impact on signal propagation performance due to the parasitics aroused by the through via connected between two different metal layers of the circuit board 7, high speed signals ($T_x^+$, $T_x^-$ and $R_x^+$, $R_x^-$) of USB 3.0 are usually distributed over a surface metal layer of the circuit board 7.

Figure 3:
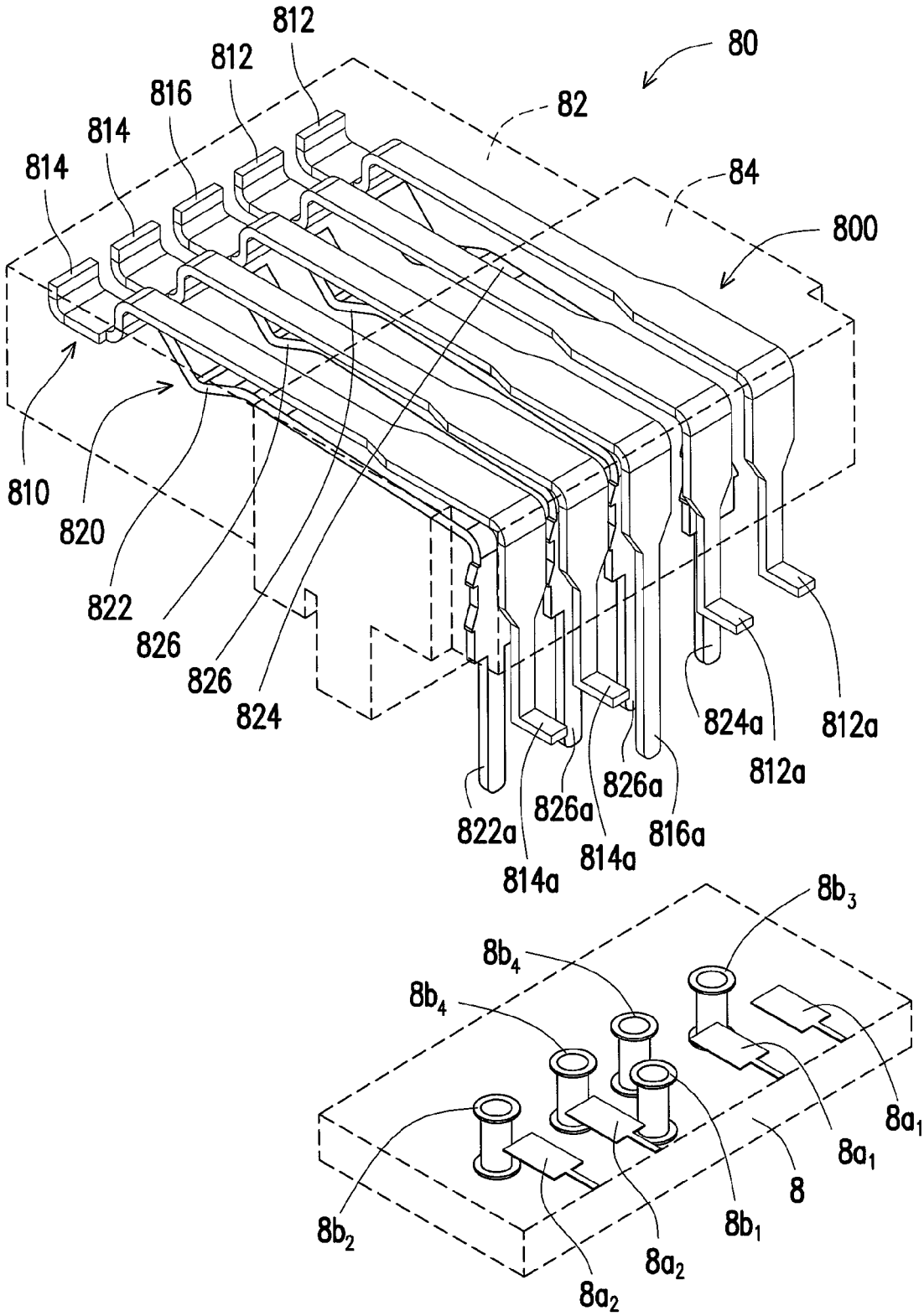
FIG. 3 and FIG. 4 illustrate a USB 3.0 electric connector according to another embodiment of the present invention, before and after assembly to a circuit board, respectively.
Figure 4:
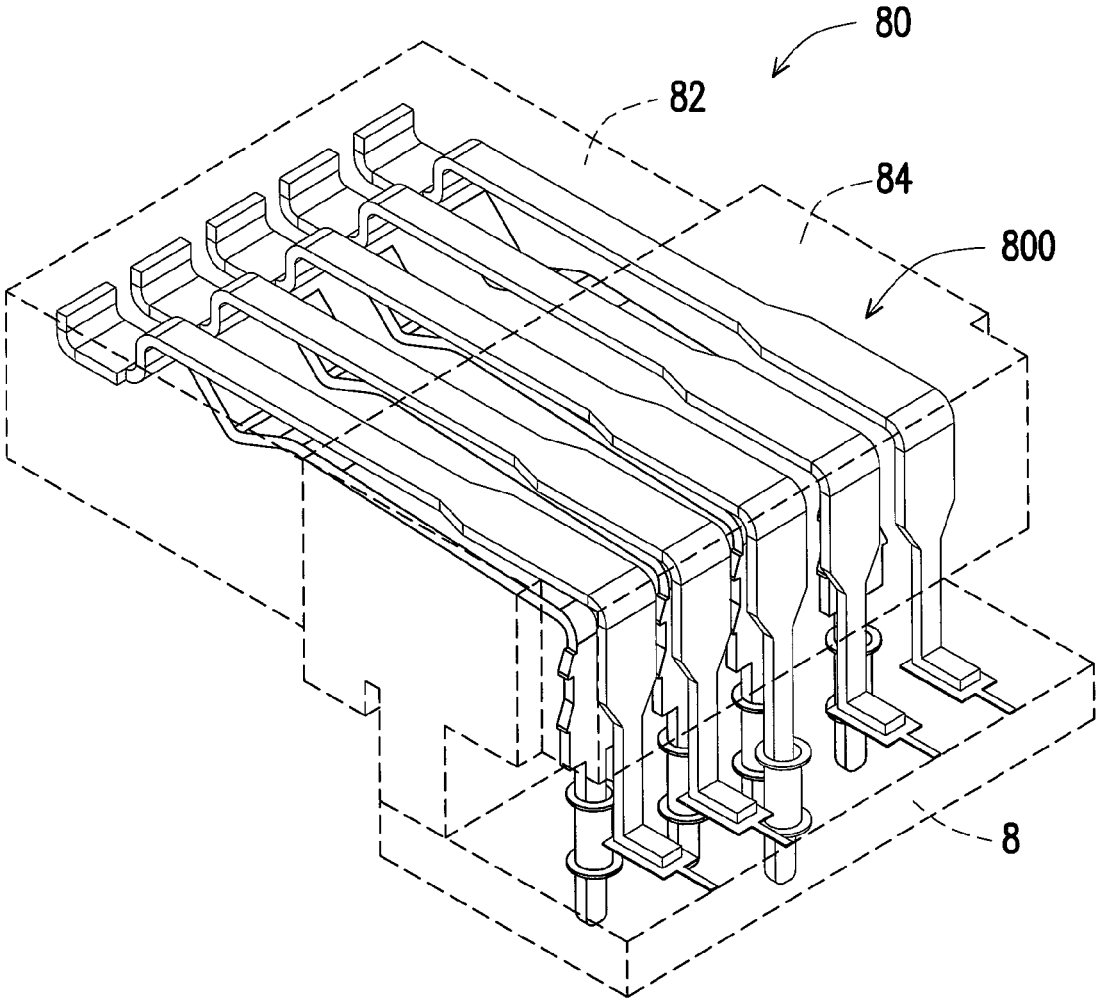

FIG. 3 and FIG. 4 illustrate a USB 3.0 electric connector according to another embodiment of the present invention, before and after assembly to a circuit board, respectively. Referring to FIG. 3 and FIG. 4, an electric connector 80 of the present embodiment is adapted for being soldered onto a circuit board 8, the electric connector 80 and the circuit board 8 collectively forming an electric assembly.

The electric connector 80 includes a metal housing 82, an insulating base 84 connected to the metal housing 82, and a lead arrangement 800 disposed on the insulating base 84. The lead arrangement 800 includes a first lead lane 810, and a second lead lane 820 positioned side-by-side with the first lead lane 810.

The first lead lane 810 includes a pair of first differential signal leads 812, a pair of second differential signal leads 814, and a first ground lead 816 positioned between the two pairs of differential signal leads 812 and 814. In the present embodiment, the pair of first differential signal leads 812 is a pair of transmitting differential signal leads $T_x^+$ and $T_x^-$ in architecture of USB 3.0, and the pair of second differential signal leads 814 is a pair of receiving differential signal leads $R_x^+$ and $R_x^-$ in architecture of USB 3.0.

Each of the pair of first differential signal leads 812 has a surface mounting segment 812*a* adapted for being soldered onto a surface pad $8a_1$ of the circuit board 8. Each of the pair of second differential signal leads 814 has a surface mounting segment 814*a* adapted for being soldered onto a surface pad $8a_2$ of the circuit board 8. In addition, the first ground lead 816 has a via passing segment 816*a* adapted for being soldered into a through via $8b_1$ of the circuit board 8.

The second lead lane 820 includes a second ground lead 822, a power lead 824 (e.g. Vcc), and a pair of third differential signal leads 826 positioned between the second ground lead 822 and the power lead 824. In the present embodiment, the pair of third differential signal leads 826 is a pair of transmitting/receiving differential signal leads $D^+$ and $D^-$ in architecture of USB 3.0 but supporting architecture of USB 1.0 or architecture of USB 2.0. In addition, the second ground lead 822 is positioned side-by-side with and adjacent to the pair of second differential signal leads 814 (e.g. the receiving differential signal leads $R_x^+$ and $R_x^-$). The power lead 824 is positioned side-by-side with and adjacent to the pair of first differential signal leads 812 (e.g. the transmitting differential signal leads $T_x^+$ and $T_x^-$).

The second ground lead 822 has a via passing segment 822*a* adapted for being soldered into a through via $8b_2$ of the circuit board 8. The power lead 824 has a via passing segment 824*a* adapted for being soldered into a through via $8b_3$ of the circuit board 8. Each of the pair of third differential signal leads 826 has a via passing segment 826*a* adapted for being soldered into a through via $8b_4$ of the circuit board 8.

The first differential signal leads 812 and the second differential signal leads 814 of the electric connector 80 are soldered onto the circuit board 8 by surface mounting. Consequently, an influence on quality of signal channel and attenuation of the transmitted signals, due to a larger parasitic capacitance caused by the portions of the two pairs of differential signal leads 812 and 814 within the circuit board 8 and the portions of the same protruding from a bottom side of the circuit board 8, are reduced. Based on the above, a transmission speed of the electric connector 80 is faster than a transmission speed of the electric connector 70.

Figure 5:
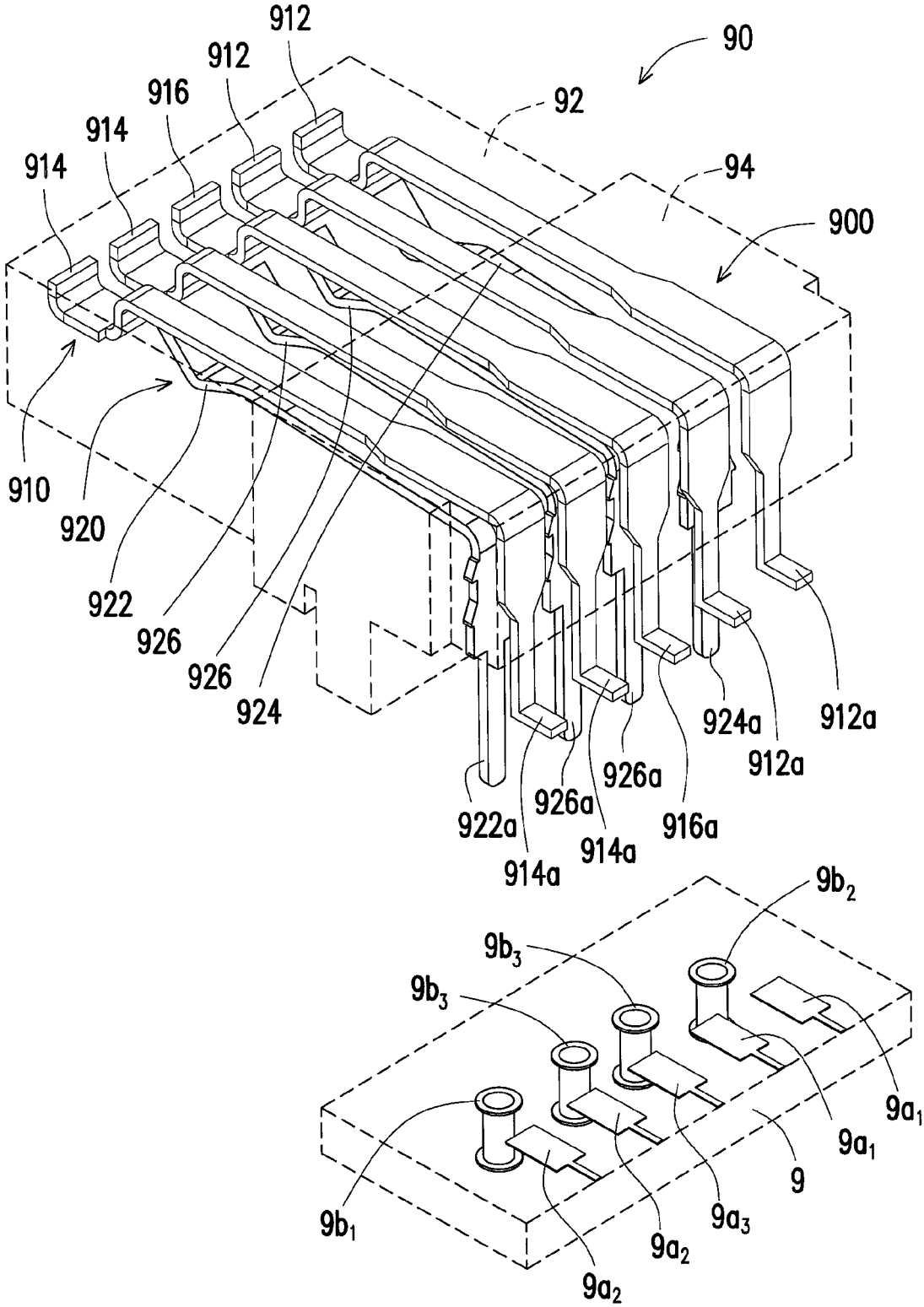
FIG. 5 and FIG. 6 illustrate a USB 3.0 electric connector according to a still another embodiment of the present invention, before and after assembly to a circuit board, respectively.
Figure 6:
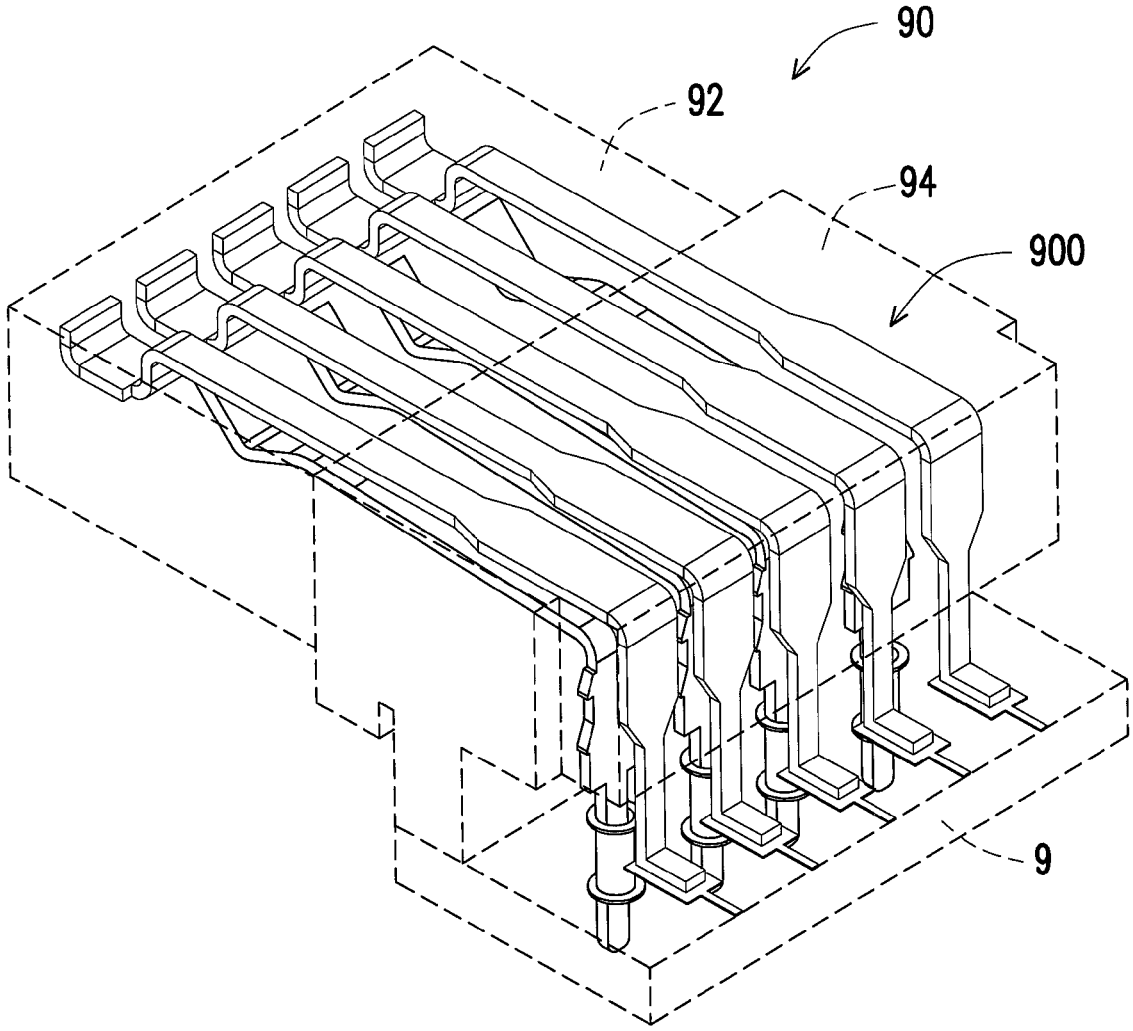

FIG. 5 and FIG. 6 illustrate a USB 3.0 electric connector according to a still another embodiment of the present invention, before and after assembly to a circuit board, respectively. Referring to FIG. 5 and FIG. 6, an electric connector 90 of the present embodiment is adapted for being soldered onto a circuit board 9, the electric connector 90 and the circuit board 9 collectively forming an electric assembly.

The electric connector 90 includes a metal housing 92, an insulating base 94 connected to the metal housing 92, and a lead arrangement 900 disposed on the insulating base 94. The lead arrangement 900 includes a first lead lane 910, and a second lead lane 920 positioned side-by-side with the first lead lane 910.

The first lead lane 910 includes a pair of first differential signal leads 912, a pair of second differential signal leads 914, and a first ground lead 916 positioned between the two pairs of differential signal leads 912 and 914. In the present embodiment, the pair of first differential signal leads 912 is a pair of transmitting differential signal leads $T_x^+$ and $T_x^-$ in architecture of USB 3.0, and the pair of second differential signal leads 914 is a pair of receiving differential signal leads $R_x^+$ and $R_x^-$ in architecture of USB 3.0.

Each of the pair of first differential signal leads 912 has a surface mounting segment 912*a* adapted for being soldered onto a surface pad $9a_1$ of the circuit board 9. Each of the pair of second differential signal leads 914 has a surface mounting segment 914*a* adapted for being soldered onto a surface pad $9a_2$ of the circuit board 9. In addition, the first ground lead 916 also has a surface mounting segment 916*a* adapted for being soldered onto a surface pad $9a_3$ of the circuit board 9.

The second lead lane 920 includes a second ground lead 922, a power lead 924 (e.g. Vcc), and a pair of third differential signal leads 926 positioned between the second ground lead 922 and the power lead 924. In the present embodiment, the pair of third differential signal leads 926 is a pair of transmitting/receiving differential signal leads $D^+$ and $D^-$ in architecture of USB 3.0 but supporting architecture of USB 1.0 or architecture of USB 2.0. In addition, the second ground lead 922 is positioned side-by-side with and adjacent to the pair of second differential signal leads 914 (e.g. the receiving differential signal leads $R_x^+$ and $R_x^-$). The power lead 924 is positioned side-by-side with and adjacent to the pair of first differential signal leads 912 (e.g. the transmitting differential signal leads $T_x^+$ and $T_x^-$).

The second ground lead 922 has a via passing segment 922*a* adapted for being soldered into a through via $9b_1$ of the circuit board 9. The power lead 924 has a via passing segment 924*a* adapted for being soldered into a through via $9b_2$ of the circuit board 9. Each of the pair of third differential signal leads 926 has a via passing segment 926*a* adapted for being soldered into a through via $9b_3$ of the circuit board 9.

The first differential signal leads 912, the second differential signal leads 914, and the first ground lead 916 of the electric connector 90 are soldered onto the circuit board 9 by surface mounting. Consequently, an influence on the quality of signal channel and attenuation of the transmitted signals, due to a larger parasitic capacitance caused by the portions of the two pairs of differential signal leads 912 and 914 as well as the first ground lead 916 within the circuit board 9 and the portions of the same protruding from a bottom side of the circuit board 9, are reduced. Based on the above, a transmission speed of the electric connector 90 is faster than a transmission speed of the electric connector 70.

In the embodiment, the connector 90 provides the full-duplex transmission and half-duplex transmission for a signal processing unit (not illustrated) disposed on the circuit board 9. The surface pads $9a_1$, $9a_2$ and $9a_3$ are connected to a plurality of surface trace of the circuit board 9 respectively, and the through via $9b_1$, $9b_2$ and $9b_3$ are connected to a plurality of inner trace of the circuit board 9 respectively. The connector 90 connects to the signal processing unit through the surface pads $9a_1$, $9a_2$ and $9a_3$, the surface traces, the through via $9b_1$, $9b_2$ and $9b_3$ and inner traces. Thus, the connector 90 provides the full-duplex transmission for the signal processing unit because the pair of first differential signal leads 912 connects to the signal processing unit through surface traces and the surface pads surface pads $9a_1$ and the pair of second differential signal leads 914 connects to the signal processing unit through the surface traces and the surface pads $9a_2$. The connector 90 also provides the half-duplex transmission for the signal processing unit since the pair of third differential signal leads 926 connects to the signal processing unit through the through vias $9b_3$ and the inner traces.

Figure 7:
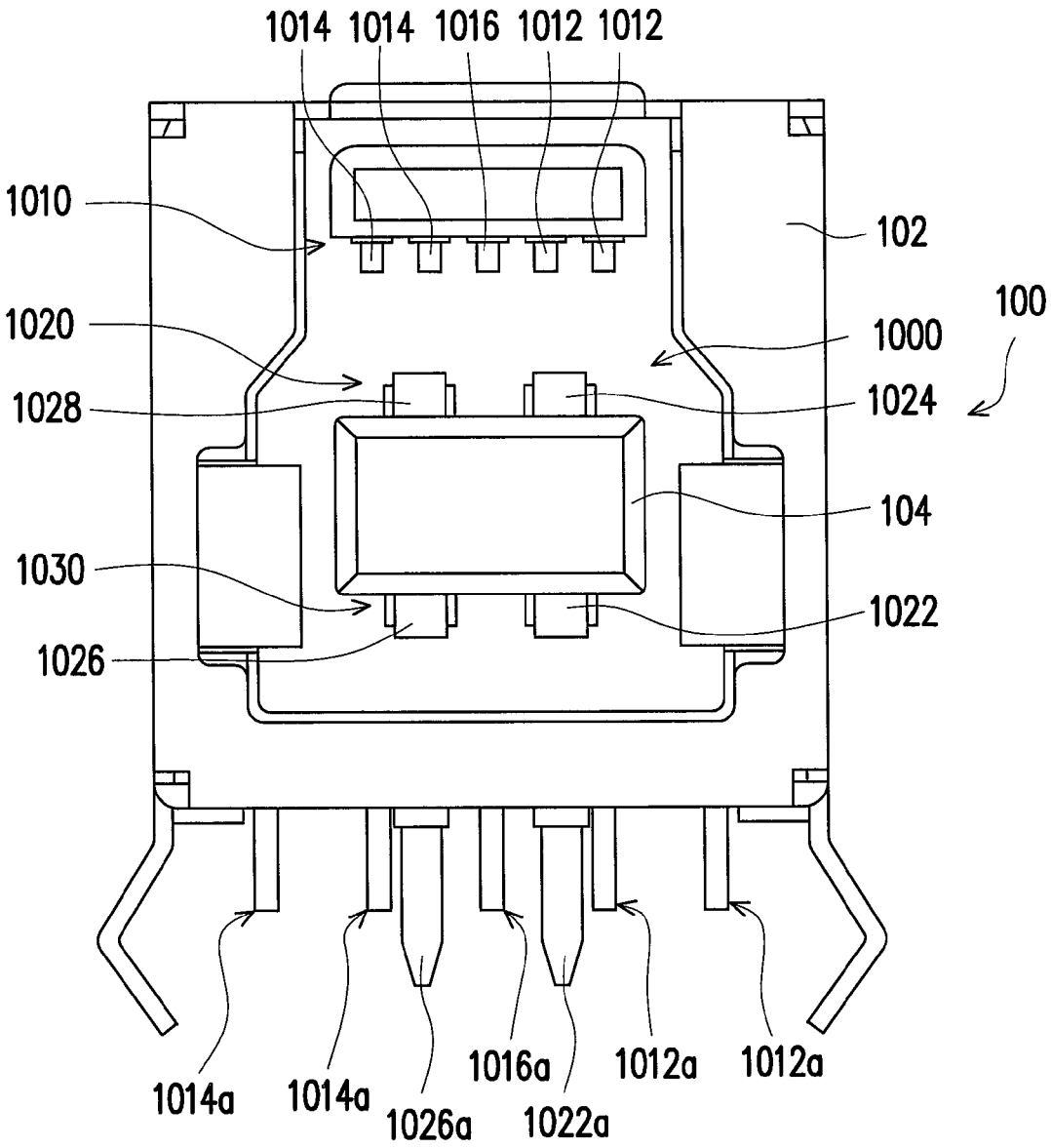
FIG. 7 and FIG. 8 illustrate a front view and a side view, respectively, of a USB 3.0 electric connector according to a yet still another embodiment of the present invention.
Figure 8:
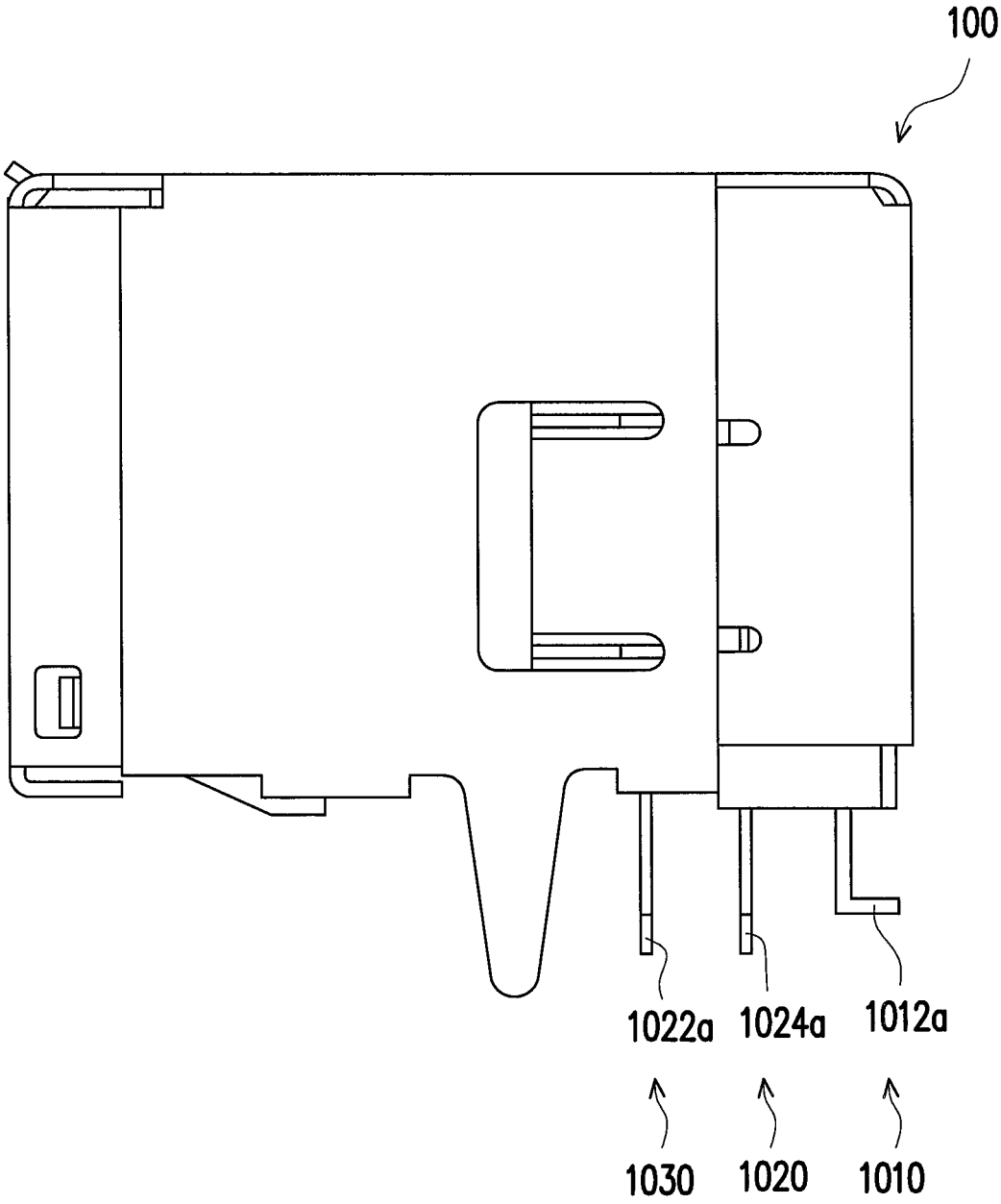

FIG. 7 and FIG. 8 illustrate a front view and a side view of a USB 3.0 electric connector according to a yet still another embodiment of the present invention, respectively. Referring to FIG. 7 and FIG. 8, an electric connector 100 of the present embodiment is adapted for being soldered onto the circuit board 9, the electric connector 100 and the circuit board 9 collectively forming an electric assembly.

The electric connector 100 includes a metal housing 102, an insulating base 104 connected to the metal housing 102, and a lead arrangement 1000 disposed on the insulating base 104. A major difference between the electric connector 100 and the electric connector 90 lies in that the lead arrangement 1000 of the electric connector 100 includes a first lead lane 1010, a second lead lane 1020, and a third lead lane 1030.

The first lead lane 1010 includes a pair of first differential signal leads 1012, a pair of second differential signal leads 1014, and a first ground lead 1016 positioned between the two pairs of differential signal leads 1012 and 1014. The arrangement manner thereof is the same as that of the aforementioned first lead lane 910 of the electric connector 90. In the present embodiment, the pair of first differential signal leads 1012 is a pair of transmitting differential signal leads $R_x^+$ and $R_x^-$ in architecture of USB 3.0, and the pair of second differential signal leads 1014 is a pair of receiving differential signal leads $T_x^+$ and $T_x^-$ in architecture of USB 3.0. The pair of differential signal leads 1012 and the pair of differential signal leads 1014 provide the capability of full-duplex transmission. In light of the current embodiment, it also provides capability of the full-duplex transmission if the pair of first differential signal leads 1012 is a pair of transmitting differential signal leads Tx+ and Tx− and the pair of second differential signal leads 1014 is a pair of receiving differential signal leads Rx+ and Rx−.

In addition, each of the pair of first differential signal leads 1012 has a surface mounting segment 1012*a*, each of the pair of second differential signal leads 1014 has a surface mounting segment 1014*a*, and the first ground lead 1016 has a surface mounting segment 1016*a*, adapted for being soldered respectively onto surface pads of a circuit board (not illustrated).

On the other hand, the second lead lane 1020 includes a power lead 1024 and a first signal lead 1028, while the third lead lane 1030 includes a second signal lead 1026 and a second ground lead 1022. The second lead lane 1020 and the third lead lane 1030 are disposed side-by-side and in alignment with each other on two sides of the insulating base 104. The first signal lead 1028 and the second signal lead 1026 form a pair of third differential signal leads. In the present embodiment, the first signal lead 1028 and the second signal lead 1026 are, respectively, a pair of transmitting/receiving differential signal leads $D^-$ and $D^+$ supporting architecture of USB 1.0 or architecture of USB 2.0.

The second ground lead 1022 has a via passing segment 1022*a* and the power lead 1024 has a via passing segment 1024*a*, adapted for being soldered into through vias of a circuit board. Similarly, the pair of third differential signal leads 1026 and 1028 has a via passing segment 1026*a* and 1028*a*, respectively, adapted for being soldered respectively into the through vias of the circuit board (not illustrated).

The electric connector 90 is, for example, a Standard-A type electric connector among USB 3.0 electric connectors. The electric connector 100 is, for example, a Standard-B type electric connector among USB 3.0 electric connectors. Based on the above, the transmission speed of the electric connector 90 is faster than the transmission speed of the electric connector 70. Furthermore, the surface mounting manner in which the first lead lane in the lead arrangement is soldered onto the surface pad of the circuit board by surface mounting is applicable to different types of electric connectors.

Figure 9:
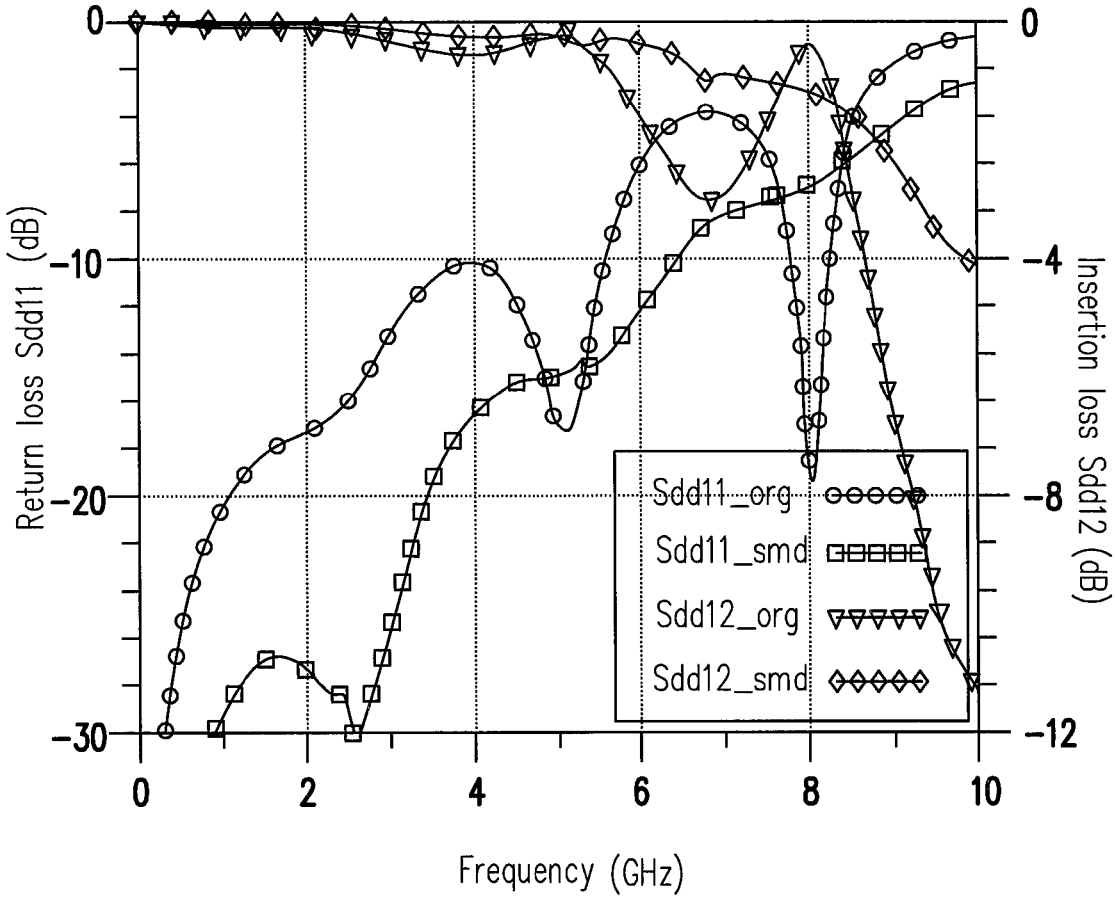
FIG. 9 illustrates a comparison between the performance of the electric connectors assembled to the circuit boards of FIG. 2 and FIG. 4 in USB 3.0 differential modes.

FIG. 9 illustrates a comparison between the performance of the electric connectors assembled to the circuit boards of FIG. 2 and FIG. 4 in USB 3.0 differential modes. Referring to FIG. 9, as a signal speed of USB 3.0 reaches 5 G bps, a clock corresponding thereto is 2.5 GHz. Preferably, the channel performance is increased by three times of frequency, i.e. to 7.5 GHz.

From the comparison between responses in the USB 3.0 differential mode, a differential return loss Sdd11_smd of the differential signal leads of FIG. 4 which are soldered onto the circuit board by surface mounting has a larger bandwidth, whereas a differential return loss Sdd11_org of the differential signal leads of FIG. 2 which are soldered onto the circuit board by passing the via has a smaller bandwidth.

Along with the significant improvement in the return loss, a differential insertion loss Sdd12_smd of the present embodiment of FIG. 4 is also improved, especially in the higher frequency range, in comparison with a differential insertion loss Sdd12_org of the existing structure of FIG. 2. In addition, a response ringing effect of the improved differential insertion loss Sdd12_smd is lower than that of the original differential insertion loss Sdd12_org.

From the above description, it is clear that the structure of FIG. 4 provides a better signal channel for signal propagation than the structure of FIG. 2. The reason may be that in the electric connector structure of FIG. 2, the portions of the two pairs of differential signal leads 712 and 714 (referring to FIG. 1) are disposed within the circuit board 7 and the portions of the same protruding from a bottom side of the circuit board 7. This may result in a larger parasitic capacitance and generate a response at higher frequency, thus affecting the quality of the signal channel as well as attenuating the transmitted signals. By contrast, in the present invention, the two pairs of differential signal leads 712 and 714 are connected to the surface pads of the circuit board and further connected to a control chip disposed on the circuit board through the surface wiring of the circuit board. By means of such wiring design, a better signal quality, especially that of the high speed signal, is obtained.

In summary, in the present invention, some pairs of critical differential signal leads of the electric connector are soldered onto the surface pads of the circuit board by surface mounting, thus avoiding an impact on transmission of critical signals as well as maintaining quality of high speed signal channel. In addition, in the present invention, the shape of some pairs of critical differential signal leads of the electric connector is modified so that the signal leads can be soldered onto the surface pads of the circuit board, while other components of the electric connector can be configured in accordance with the existing USB 3.0 electric connector. Therefore, the development cost of the electric connector is reduced.

Although the present invention has been described with reference to the embodiments thereof, it will be apparent to one of the ordinary skills in the art that modifications to the described embodiments may be made without departing from the spirit of the invention. Accordingly, the scope of the invention will be defined by the attached claims not by the above detailed description.

What is claimed is:

1. A lead arrangement adapted for an electric connector, the lead arrangement comprising:

a first lead lane comprising:

a pair of first differential signal leads;

a pair of second differential signal leads; and a first ground lead positioned between the two pairs of differential signal leads, wherein each of the pair of first differential signal leads, the pair of second differential signal leads and the first ground lead has a surface mounting segment adapted for being soldered onto a surface pad of a circuit board, wherein the pair of first differential signal leads is a pair of transmitting differential signal leads $T_x^+$ and $T_x^-$ in architecture of universal serial bus 3.0 (USB 3.0), and the pair of second differential signal leads is a pair of receiving differential signal leads $R_x^+$ and $R_x^-$ in architecture of USB 3.0.

2. The lead arrangement as claimed in claim 1, further comprising:

a second lead lane positioned side-by-side with the first lead lane, the second lead lane comprising:

a second ground lead;

a power lead; and a pair of third differential signal leads positioned between the second ground lead and the power lead, wherein each of the second ground lead, the power lead, and the pair of third differential signal leads has a via passing segment adapted for being soldered into a through via of the circuit board.

3. The lead arrangement as claimed in claim 2, wherein the pair of third differential signal leads is a pair of transmitting/receiving differential signal leads $D^+$ and $D^-$ in architecture of USB 3.0 but supporting architecture of USB 1.0 or architecture of USB 2.0.

4. The lead arrangement as claimed in claim 1, further comprising:

a second lead lane comprising a first signal lead and a power lead; and a third lead lane comprising a second signal lead and a second ground lead, wherein the first signal lead and the second signal lead form a pair of third differential signal leads, the second lead lane and the third lead lane are positioned side-by-side with each other, and each of the second ground lead, the power lead, and the pair of third differential signal leads has a via passing segment adapted for being soldered into a through via of the circuit board.

5. The lead arrangement as claimed in claim 1, wherein the pair of third differential signal leads is a pair of transmitting/receiving differential signal leads $D^+$ and $D^-$ supporting architecture of USB 1.0 or architecture of USB 2.0.

6. An electric connector comprising:

a metal housing;

an insulating base connected to the metal housing; and a lead arrangement disposed on the insulating base, the lead arrangement comprising:

a first lead lane comprising:

a pair of first differential signal leads;

a pair of second differential signal leads; and a first ground lead positioned between the two pairs of differential signal leads, wherein each of the pair of first differential signal leads, the pair of second differential signal leads and the first ground lead has a surface mounting segment adapted for being soldered onto a surface pad of a circuit board, wherein the pair of first differential signal leads is a pair of transmitting differential signal leads $T_x^+$ and $T_x^-$ in architecture of USB 3.0, and the pair of second differential signal leads is a pair of receiving differential signal leads $R_x^+$ and $R_x^-$ in architecture of USB 3.0.

7. The electric connector as claimed in claim 6, wherein the lead arrangement further comprises:

a second lead lane positioned side-by-side with the first lead lane, the second lead lane comprising:

a second ground lead;

a power lead; and a pair of third differential signal leads positioned between the second ground lead and the power lead, wherein each of the second ground lead, the power lead, and the pair of third differential signal leads has a via passing segment adapted for being soldered into a through via of the circuit board.

8. The electric connector as claimed in claim 7, wherein the pair of third differential signal leads is a pair of transmitting/receiving differential signal leads $D^+$ and $D^-$ in architecture of USB 3.0 but supporting architecture of USB 1.0 or architecture of USB 2.0.

9. The electric connector as claimed in claim 6, wherein the lead arrangement further comprises:

a second lead lane comprising a first signal lead and a power lead; and a third lead lane comprising a second signal lead and a second ground lead, wherein the first signal lead and the second signal lead form a pair of third differential signal leads, the second lead lane and the third lead lane are positioned side-by-side with each other, and each of the second ground lead, the power lead, and the pair of third differential signal leads has a via passing segment adapted for being soldered into a through via of the circuit board.

10. The electric connector as claimed in claim 9, wherein the pair of third differential signal leads is a pair of transmitting/receiving differential signal leads $D^+$ and $D^-$ supporting architecture of USB 1.0 or architecture of USB 2.0.

11. An electric assembly comprising:

a circuit board comprising a plurality of surface pads and a plurality of through vias; and an electric connector comprising:

a metal housing;

an insulating base connected to the metal housing; and a lead arrangement disposed on the insulating base, the lead arrangement comprising:

a first lead lane comprising:

a pair of first differential signal leads;

a pair of second differential signal leads; and a first ground lead positioned between the two pairs of differential signal leads, wherein each of the pair of first differential signal leads, the pair of second differential signal leads and the first ground lead has a surface mounting segment soldered respectively onto the plurality of surface pads, wherein the pair of first differential signal leads is a pair of transmitting differential signal leads $T_x^+$ and $T_x^-$ in architecture of USB 3.0, and the pair of second differential signal leads is a pair of receiving differential signal leads $R_x^+$ and $R_x^-$ in architecture of USB 3.0.

12. The electric assembly as claimed in claim 11, wherein the lead arrangement further comprises:

a second lead lane positioned side-by-side with the first lead lane, the second lead lane comprising:

a second ground lead;

a power lead; and a pair of third differential signal leads positioned between the second ground lead and the power lead, wherein each of the second ground lead, the power lead, and the pair of third differential signal leads has a via passing segment soldered respectively into the plurality of through vias.

13. The electric assembly as claimed in claim 12, wherein the pair of third differential signal leads is a pair of transmitting/receiving differential signal leads $D^+$ and $D^-$ in architecture of USB 3.0 but supporting architecture of USB 1.0 or architecture of USB 2.0.

14. The electric assembly as claimed in claim 11, wherein the lead arrangement further comprises:

a second lead lane comprising a first signal lead and a power lead; and a third lead lane comprising a second signal lead and a second ground lead, wherein the first signal lead and the second signal lead form a pair of third differential signal leads, the second lead lane and the third lead lane are positioned side-by-side with each other, and each of the second ground lead, the power lead, and the pair of third differential signal leads has a via passing segment adapted for being soldered into the plurality of through vias.

15. The electric assembly as claimed in claim 14, wherein the pair of third differential signal leads is a pair of transmitting/receiving differential signal leads $D^+$ and $D^-$ supporting architecture of USB 1.0 or architecture of USB 2.0.

16. An electric assembly comprising:

a circuit board comprising a plurality of surface pads and a plurality of through vias;

a signal processing unit disposed on the circuit board; and an electric connector comprising:

a metal housing;

an insulating base connected to the metal housing; and a lead arrangement disposed on the insulating base, the lead arrangement comprising:

a first lead lane comprising:

a pair of first differential signal leads;

a pair of second differential signal leads; and a first ground lead positioned between the two pairs of differential signal leads, wherein each of the pair of first differential signal leads, the pair of second differential signal leads and the first ground lead has a surface mounting segment soldered respectively onto the plurality of surface pads, and wherein the signal processing unit simultaneously transmitting signals to the pair of first differential signal leads and receiving signals from the pair of second differential signal leads through the plurality of surface pads.

17. The electric assembly as claimed in claim 16, wherein the pair of first differential signal leads is a pair of transmitting differential signal leads Tx+ and Tx− in architecture of USB 3.0, and the pair of second differential signal leads is a pair of receiving differential signal leads Rx+ and Rx− in architecture of USB 3.0.

18. The electric assembly as claimed in claim 16, wherein the lead arrangement further comprises:

a second lead lane positioned side-by-side with the first lead lane, the second lead lane comprising:

a second ground lead;

a power lead; and a pair of third differential signal leads positioned between the second ground lead and the power lead, wherein each of the second ground lead, the power lead, and the pair of third differential signal leads respectively connecting to the signal processing unit through the plurality of through vias.

19. The electric assembly as claimed in claim 18, wherein the pair of third differential signal leads is a pair of transmitting/receiving differential signal leads D+ and D− in architecture of USB 3.0 but supporting architecture of USB 1.0 or architecture of USB 2.0.

20. The electric assembly as claimed in claim 16, wherein the lead arrangement further comprises:

a second lead lane comprising a first signal lead and a power lead; and a third lead lane comprising a second signal lead and a second ground lead, wherein the first signal lead and the second signal lead form a pair of third differential signal leads, the second lead lane and the third lead lane are positioned side-by-side with each other, and each of the second ground lead, the power lead, and the pair of third differential signal leads respectively connecting to the signal processing unit through the plurality of through vias.

21. The electric assembly as claimed in claim 20, wherein the pair of third differential signal leads is a pair of transmitting/receiving differential signal leads D+ and D− supporting architecture of USB 1.0 or architecture of USB 2.0.

* * * * *